US007062808B1

(12) United States Patent
Brogden

(10) Patent No.: US 7,062,808 B1
(45) Date of Patent: Jun. 20, 2006

(54) SYSTEMS AND METHODS FOR ENCASING MATTRESSES

(75) Inventor: Randy Brogden, Suwanee, GA (US)

(73) Assignee: National Allergy Supply, Inc., Duluth, GA (US)

( * ) Notice: Subject to any disclaimer, the term of this patent is extended or adjusted under 35 U.S.C. 154(b) by 0 days.

(21) Appl. No.: 11/063,055

(22) Filed: Feb. 22, 2005

(51) Int. Cl.
*A47G 9/00* (2006.01)

(52) U.S. Cl. ..... 5/699; 5/497; 5/499; 5/735

(58) Field of Classification Search ..... 5/699, 5/484, 497, 499, 738, 487, 500
See application file for complete search history.

(56) References Cited

U.S. PATENT DOCUMENTS 4,136,413 A * 1/1979 Scales ..... 5/423
5,050,256 A 9/1991 Woodcock ..... 5/699
5,090,074 A * 2/1992 Scales et al. ..... 5/699
5,101,527 A * 4/1992 Wadsworth et al. ..... 5/727
5,950,264 A 9/1999 Wyner et al. ..... 5/690
6,243,895 B1 * 6/2001 Amin ..... 5/498
6,253,398 B1 7/2001 Yim ..... 5/499
6,277,770 B1 8/2001 Smith, III ..... 442/190
2002/0148047 A1 * 10/2002 Corzani et al. ..... 5/738

* cited by examiner

*Primary Examiner*—Michael Trettel
(74) *Attorney, Agent, or Firm*—Thomas, Kayden, Horstemeyer & Risley, LLP

(57) ABSTRACT

Zipper-less encasing systems for a mattress are disclosed. One such system includes a bottom encasing configured to fit snugly over a bottom portion of the mattress and a top encasing configured to fit snugly over a top portion of a mattress and overlap with a portion of the bottom encasing, with the mattress completely covered by portions of both the bottom encasing and the top encasing. Also disclosed are beds, and methods of protecting a mattress.

23 Claims, 3 Drawing Sheets

SYSTEMS AND METHODS FOR ENCASING MATTRESSES

TECHNICAL FIELD

The present invention is generally related to technology, materials, and methods for protecting bedding products, and, more particularly, is related to mattress encasings and methods for encasing mattresses.

BACKGROUND

It is known that house mites, or dust mites, are a source of allergens that not only cause allergies, but also adversely contribute to other pathologies such as asthma. It has also been established that use of allergen control measures is effective in controlling these conditions. Allergen-proof encasing to contain mites to prevent allergen egress has long been used in bedding (e.g., mattresses, pillows, duvets, and bed upholstery).

Encasings are specially designed covers for pillows, mattresses, duvets, comforters, and box springs. They function to block dust mite allergens so that a user does not breathe them in during sleep or use of a bed. Mattress encasings in particular are usually constructed of two pieces of material cut to fit various lengths of mattresses (e.g., twin, double, queen, or king) and joined by at least one seam that runs around the entire middle of the edge of the mattress. Around one end of the mattress encasing (e.g., at the "head" or "foot" of the mattress), the seam is replaced with a zipper that allows the mattress encasing to be put on the bed. Often, mattress encasings also have two more seams around the entire length of the mattress encasing, along both the top and bottom edges of the mattress. The additional seams may be necessary so that the top or center portion of the mattress encasing can be of a different material or fabric than the rest of the mattress encasing, e.g., to provide a fluid-resistant backing on the top portion of the encasing that is not desired on the bottom portion of the encasing. Dust mite allergens, though, escape through seams, and especially through zippers, which have a plurality of openings that exceed the size of dust mite allergens. A typical twin-size mattress encasing has seams on each corner, seams on the perimeter of the encasing, and double seams where the zipper is, e.g., about 24 feet of seams in all.

Usually the encasing is applied to the mattress by standing the mattress on one end and slipping the encasing over the mattress through the open zippered portion. Once the encasing is nearly completely over the mattress, the mattress is laid flat, and the zippered portion is then zipped closed. This is an unwieldy and time-consuming process. Even though allergists recommend that mattress encasings be frequently washed in ultra high temperatures or with an anti-dust mite laundry additive to increase their efficacy, the process for removing and re-applying the mattress encasings to the mattress discourages users from doing so. Additionally, traditional mattress encasings cannot be used with waterbeds or beds with adjustable air chambers, such as that sold under the Select Comfort® brand name by Select Comfort Corporation of Minneapolis, Minn., USA.

To the extent that such encasing comes in direct or indirect (i.e., through the bed sheets or pillowcases) contact with the human body, it is desired that it be pleasant to the touch and be moisture-vapor permeable. For aesthetic as well as for comfort reasons, it is also desirable that the material has a good drape and does not feel stiff. The prior art has variously attempted to solve these problems.

Mattress encasings have been made from a variety of different materials. It is generally desired that the material have a pore size of less than 10 microns so as to prevent allergens present in the mattress from leaking out. For example, one material used for mattress encasings is knit polyester with a polyurethane backing. The polyurethane backing lends a waterproofing characteristic to the mattress encasing. Spunbond/meltblown/spunbond (SMS) polyolefin nonwovens have also been used in mattress and pillow covers, and they do provide a degree of barrier protection to allergens. SMS nonwovens also exhibit excellent air porosity. Very tightly woven fabrics have also been used for mattress encasings, such as, for example, woven polyester or nylon, woven cotton/polyester blends, and even 100% woven cotton. The woven allergen-barrier fabrics of mattress encasings have been woven from continuous natural and/or synthetic filament and/or spun yarns, with various finishes to yield pore sizes less than 10 microns.

Disposable mattress covers have also been used in the art to prevent contamination of mattresses, and also to prevent or control the presence of dust mite allergens from the user. Known disposable mattress covers comprise different materials or structures that are capable of providing a liquid barrier, in addition to providing moisture vapour permeability, preferably air permeability. Such structures or materials can comprise a single layer, or multiple layers laminated together. An exemplary structure comprises thermoplastic microporous films, e.g., laminated to fibrous layers such as nonwoven layers. Additional materials that are suitable for disposable mattress covers are hydrophilic continuous films, also known as "monolithic films." These materials do not allow the flow of moisture vapor through open pores or apertures in the material. The materials do transfer substantial amounts of moisture vapor through the film by absorbing water on one side of the film where the moisture vapor concentration is higher, and desorbing or evaporating it on the opposite side of the film where the moisture vapour concentration is lower.

SUMMARY OF THE DISCLOSURE

Briefly described, embodiments of the present disclosure include encasing systems for a mattress, bed, and methods of protecting a mattress. In particular, one embodiment of the disclosed systems is a zipper-less encasing system that includes a bottom encasing configured to fit snugly over a bottom portion of the mattress and a top encasing configured to fit snugly over a top portion of the mattress and overlap with a portion of the bottom encasing, the mattress being completely covered by portions of both the bottom encasing and the top encasing.

One embodiment of the disclosed beds includes a mattress and an encasing for a mattress, the encasing including a bottom component fitted over a bottom portion of the mattress, and a top component fitted over a top portion of the mattress, at least one section of the top component of the encasing overlapping with the bottom component of the encasing. In this embodiment, the encasing completely covers the mattress.

One embodiment of the disclosed methods includes disposing a bottom piece of a mattress encasing on the mattress and fitting snugly thereon and disposing a top piece of a mattress encasing on a mattress and fitting snugly thereon, at least one section of the top piece overlapping with the bottom piece on at least one side of the mattress, and the bottom piece and the top piece of the encasing being in zipper-less communication with each over. In one embodiment of the method, the bottom piece and the top piece of the encasing completely cover the mattress.

Other systems, methods, features, and advantages of the present disclosure will be or will become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of this disclosure can be better understood with reference to the following drawings. The components in the drawings are not necessarily to scale, emphasis instead being placed upon illustrating the principles of this disclosure. Moreover, in the drawings, like reference numerals designate corresponding parts throughout the several views.

DETAILED DESCRIPTION

Disclosed herein are systems and methods for protecting a mattress from infiltration by allergens, moisture, stains, etc. The systems include an encasing for the mattress, the encasing being in at least two components. In one embodiment, the two encasing components are not sewn, stitched, or zippered together. The methods include encasing a mattress in at least two encasing pieces, one piece being applied to the bottom of the mattress, and the second piece being applied to the top of the mattress.

Figure 1:
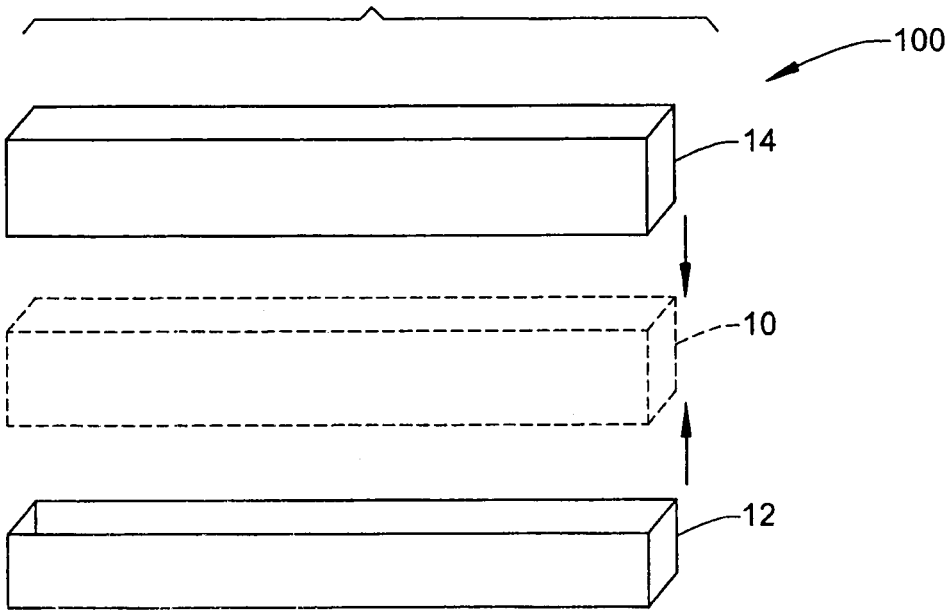
FIG. 1 is an exploded view of one embodiment of the disclosed encasings before being inserted onto a mattress.
Figure 2:
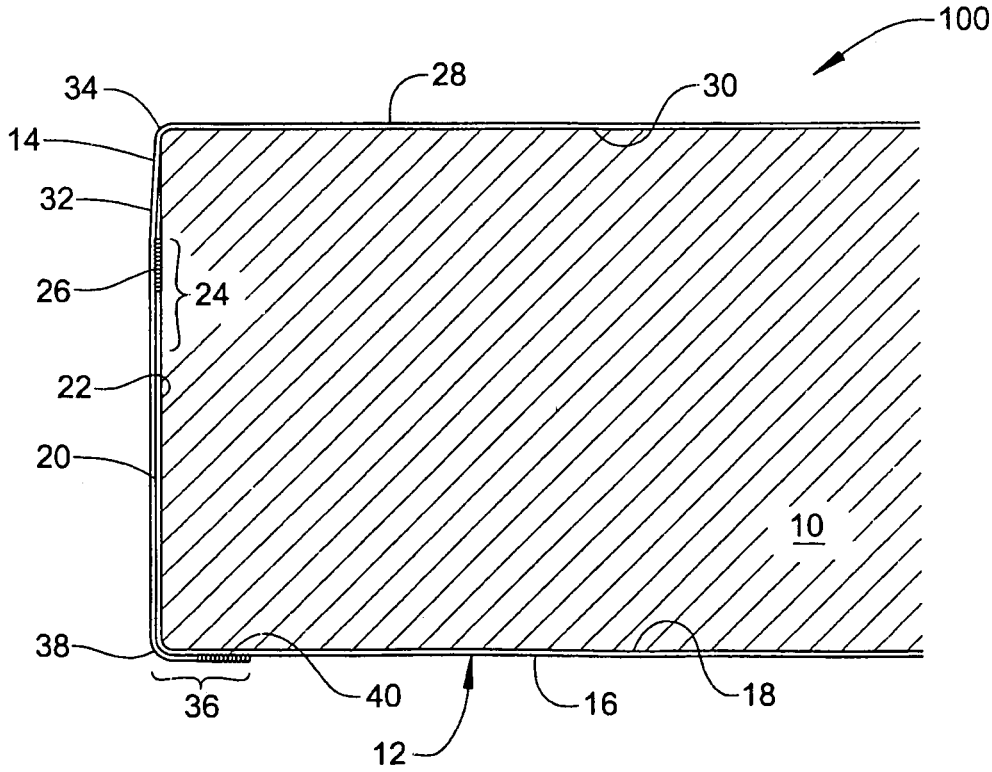
FIG. 2 is a cross-sectional view of the mattress of FIG. 1 after one embodiment of the disclosed mattress encasings has been disposed thereon.
Figure 3:
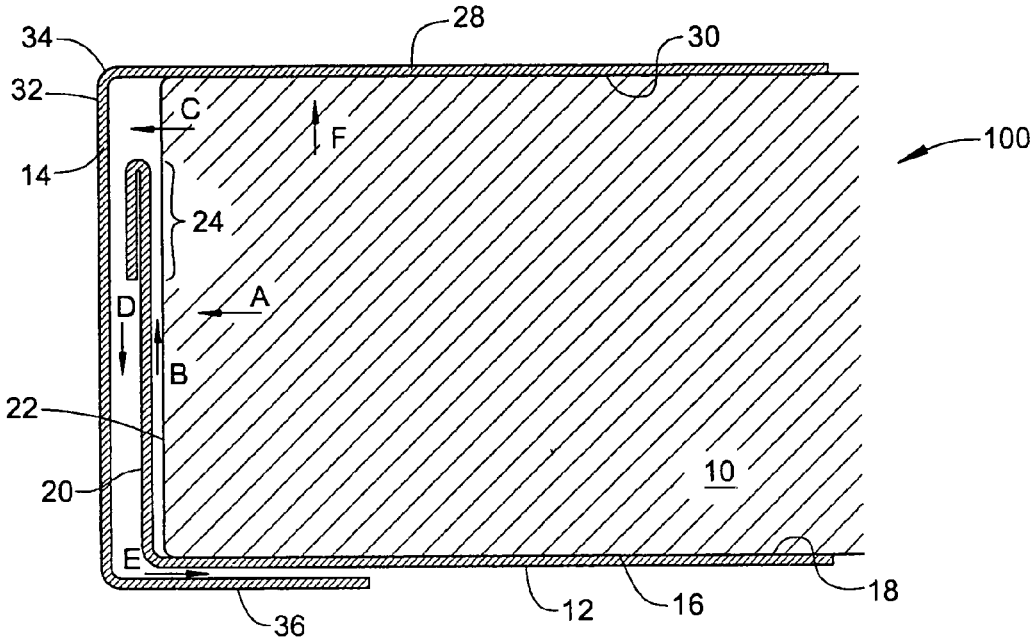
FIGS. 3 is a cross-sectional view of a mattress after an alternative embodiment of the disclosed mattress encasings has been disposed thereon.

Referring now in more detail to the figures, in which like reference numerals identify corresponding parts, FIG. 1 depicts an exploded view of one embodiment of the disclosed mattress encasing system 100. The mattress encasing system 100 includes a bottom encasing 12, a mattress 10, and a top encasing 14, where each are shown before the top and bottom encasings 10, 12 are inserted onto the mattress 10. While the mattress encasing system 100 includes the mattress 10 in the embodiment shown in FIG. 1, other embodiments of the disclosed encasing systems do not necessarily include the mattress 100, but may include only the bottom encasing 12 and the top encasing 14. FIG. 2 illustrates a cross-sectional view of the system 100 of FIG. 1, after one embodiment of the disclosed mattress top and bottom encasings 12, 14 have been disposed on the mattress 10. The embodiment of the encasing system 100 shown in FIGS. 1–4 herein is zipper-less. The encasing system 100 includes the bottom encasing 12, which is configured to fit snugly over a bottom portion of the mattress 10, and the top encasing 14, which is configured to fit snugly over a top portion of the mattress 10 and overlap with a portion of the bottom encasing 12. The mattress 10 is completely covered by portions of both the bottom encasing 12 and the top encasing 14.

The bottom encasing 12 includes a bottom portion 16 that is configured to fit a bottom side 18 of the mattress 10, and four side portions 20 configured to at least partially cover sides 22 of the mattress 10. The four side portions 20 of the bottom encasing 12 extend up continuously from the bottom portion 16, without seams. The four side portions 20 can extend upwardly a distance of, for example, about 7 inches up to about 26 inches, depending on the thickness of the mattress. In one embodiment, the four side portions 20 of the bottom encasing 12 are connected with seams to each other at each of the four corners of the mattress 10. The four side portions 20 of the bottom encasing 12 include a bottom edge 38 that is adjacent the bottom portion 16 of the bottom encasing 12. The four side portions 20 of the bottom encasing 12 also include a top edge 24 that surrounds the sides 22 of the mattress 10.

In one embodiment, the top edge 24 is bound with an elastic seam 26 that holds the bottom encasing 12 snugly against the mattress 10. In an alternative embodiment, such as that shown in FIG. 3, the bottom encasing 12 is disposed on the mattress 10 and the top edge 24 of the bottom encasing 12 folds back over itself, whereby the sides 22 of the mattress are covered in part by two layers of the bottom encasing 12.

When the mattress 10 is compressed (e.g., when an individual lies down on the mattress), air in the mattress 10 that includes dust mites and/or dust mite allergens is forced out. Because air in the mattress 10 will take the path of least resistance, in the mattress encasing system 100, air will typically pass through a suitable barrier material of the encasing system 100 and is thereby filtered. Weight placed on the mattress 10 of FIG. 3 forces the mattress 10 onto a bottom portion 36 of the top encasing 14 that is folded under the mattress 10. Air therefore more easily travels in directions A or F out of the mattress 10. In order for air to leave the mattress 10 unfiltered, it would have to travel in directions of arrows A, B, C, D, and E, which is not likely to occur. Thus, the encasing system 100 reduces the flow of allergens out of the mattress altogether. Because the top encasing 14 of the encasing system 100 is easily removed, the trapped allergens can be washed away with more frequent washings.

Returning to FIGS. 2 and 3, the top encasing 14 includes a top portion 28 that is configured to fit a top side 30 of the mattress 10, four side portions 32 that are configured to at least partially cover sides 22 of the mattress 10, and the bottom portion 36 configured to at least partially cover the bottom side 18 of the mattress 10. The four side portions 32 of the top encasing 14 extend down continuously from the top portion 28 without seams connecting the side portions 32 to the top portion 28. The four side portions 32 of the top encasing 14 are connected with seams to each other at each of the four corners of the mattress 10.

The four side portions 32 of the top encasing 14 include a top edge 34 that is adjacent with the top portion 28 of the top encasing 14. The four side portions 32 further include a bottom edge 38 that is adjacent with the bottom portion 36 of the top encasing 14 and that surrounds the sides 22 of the mattress 10. The bottom portion 36 of the top encasing 14 is bound with an elastic seam 40 that holds the top encasing 14 snugly against the bottom encasing 12.

Figure 4:
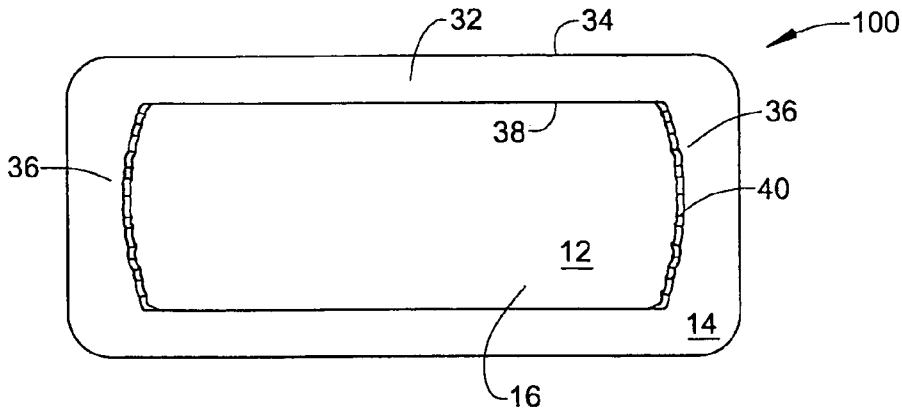
FIG. 4 is a bottom view that illustrates a mattress after one embodiment of the disclosed mattress encasings has been disposed thereon.

FIG. 4 is a bottom view illustration of one embodiment of the disclosed mattress encasing system 100, with both the bottom encasing 12 and the top encasing 14 disposed on the mattress 10. The embodiment shown includes the elastic seam 40 that is included on the bottom portion 36 of the top encasing 12. While the figure depicts the elastic seam 40 running only around the ends of the mattress (e.g., only the end portions of the bottom portion 36 of the top encasing 12), the elastic seam 40 can also run along the edge of the entire bottom portion 36.

Overall, the bottom encasing 12 and the top encasing 14 of the encasing system 100 have a fewer number of seams than encasings that include a zipper, thereby providing greater allergen protection to users of the mattress 10. Indeed, one embodiment of the disclosed zipper-less encasing system has approximately 80% fewer seams and needle holes than traditional mattress encasings for twin- and full-sized encasings, and about 50 fewer seams for queen- and king-sized mattresses. The seams of the encasings disclosed herein reside only on each side, and not on the ends, as with conventional mattresses.

Additionally, one embodiment of the zipper-less encasing systems disclosed herein can be used on air type mattresses that have air tubes permanently attached, with only minimal loss of efficiency of the encasing. The encasing system 100 can be installed on waterbeds that use standard sheets, with the bottom encasing 12 installed before the bed is filled with water. After the encasing system 100 is in place on the waterbed, only the top encasing 14 of the encasing system 100 need be removed for washing, or changing out. Alternatively, if the waterbed is already filled with water, then at least the top encasing 14 can be used on the waterbed for some measure of allergen protection for the user.

The bottom encasing 12 and the top encasing 14 can be made from the same materials or different materials, so long as at least the top encasing 14 is made from a material that acts as a barrier to prevent at least one of dust mites, dust mite allergens, and/or cat dander from passing therethrough. In one embodiment, the bottom encasing 12 and/or the top encasing 14 is made of a material that is configured to allow airflow of at least about 29 liters/minute. In one embodiment, the bottom encasing 12 and/or the top encasing 14 is made of a material that is configured to allow less than about 0.31 ng of *Felis domesticus* (Fel d1) therethrough, while allowing through an airflow of at least about 29 liters/minute. In one embodiment, the bottom encasing 12 and/or the top encasing 14 is made of a material that is configured to allow less than about about 1.25 ng of *Dermatophagoides farinae* (Der f1) therethrough, while allowing through an airflow of at least about 29 liters/minute. The bottom encasing 12 and/or the top encasing 14 can be made of a material that has a mean pore size of about 3.2 μm to about 3.3 μm.

In one embodiment, the top encasing 14 can be made from, for example, at least one of the following materials: a knit polyester, a knit polyester with a polyurethane backing, a spunbond/meltblown/spunbond olefin, a woven polyester, a woven cotton-polyester blend, and combinations thereof. The spunbond/meltblown/spunbond olefin material can include two spunbond olefin layers that are heat bonded to each side of a meltblown olefin layer. In an embodiment in which the top encasing 14 is made of a material that includes woven polyester, polyester is woven tight enough to prevent dust mites and/or dust mite allergens from passing through the woven polyester material. The material of the bottom encasing 12 can be any barrier material, for example, a material that has some elasticity and will hug or grip the side of the mattress 10. Non-stretch materials can be used if the corners have elastic or the side portions 20 are made to stay on the side of the mattress subjected to frequent use.

Figure 5:
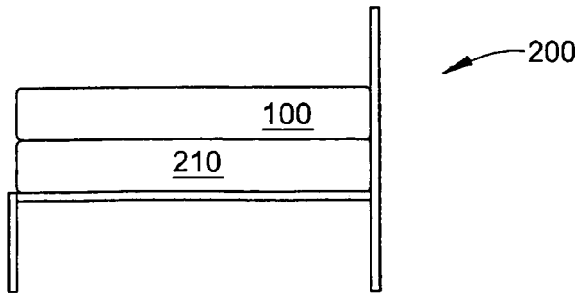
FIG. 5 is a side view of a bed that incorporates the encasing of FIG. 1.

FIG. 5 depicts a side view of a bed 200 that incorporates the exemplary encasing system 100. The bed 200 includes optional box springs 210 with the encasing system 100 disposed on the box springs 210. In the encasing system 100 depicted in FIG. 5, the top and bottom encasings 12, 14 completely cover the mattress 10. The bed 200 can be of any size, for example, but not limited to the following: crib, twin, extra-long twin, full, double, queen, king, European queen, and California king.

Figure 6:
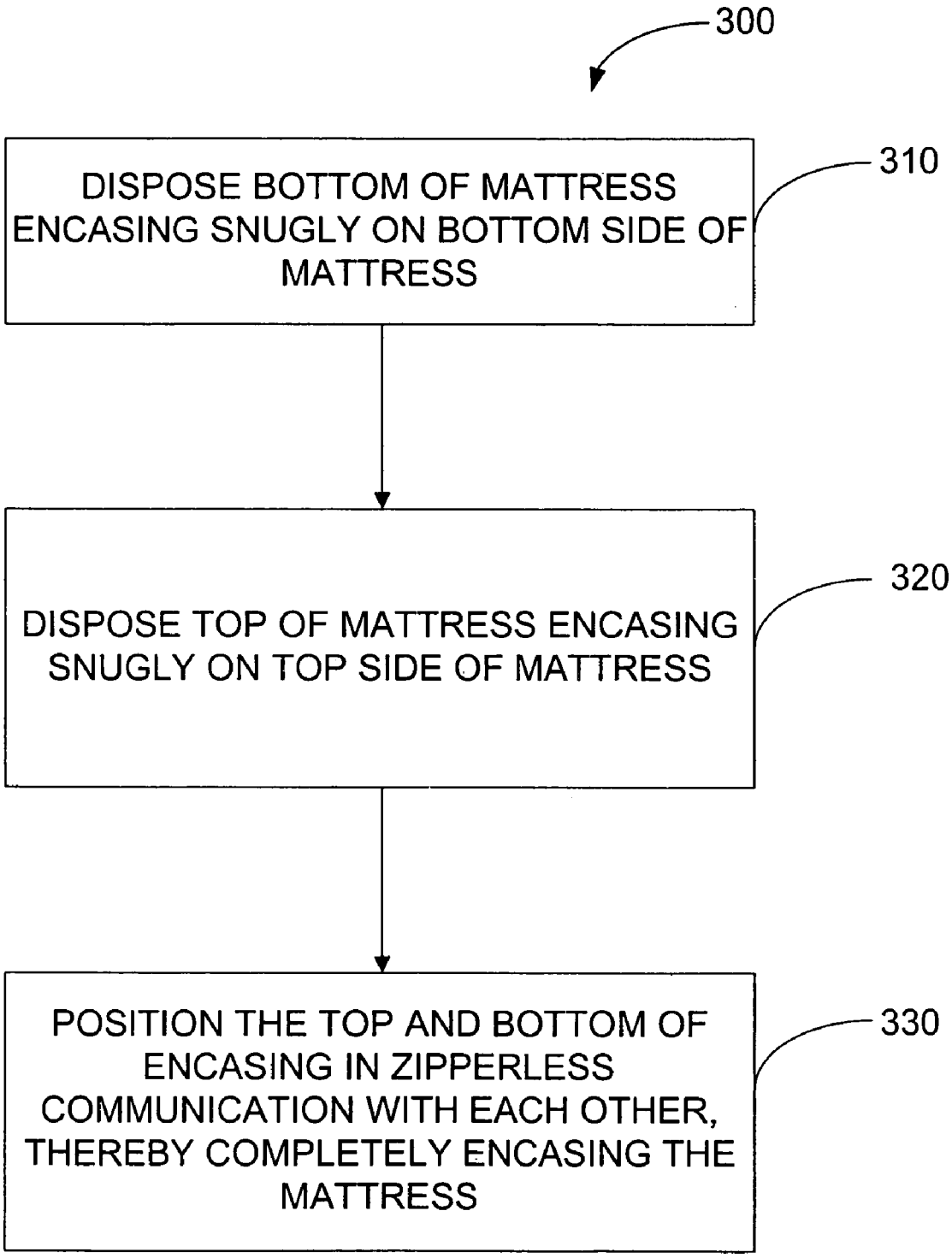
FIG. 6 is a flow chart of a representative method for protecting a mattress.

Also disclosed is a method of protecting a mattress, which generally includes disposing the disclosed mattress encasing systems on a mattress. One particular embodiment of such a method is shown in the flowchart of FIG. 6. In FIG. 6, the exemplary method 300 starting at block 310 with disposing a bottom piece of a mattress encasing on the mattress and snugly fitting the bottom piece of the mattress encasing on the mattress. Next, as shown in block 320, a top piece of a mattress encasing is disposed on a mattress and also fitted snugly thereon. In this embodiment of the method, at least one section of the top piece overlaps with the bottom piece on at least one side of the mattress. Other configurations are contemplated, such as, for example, overlapping the top edge of the side portion of the bottom piece of the encasing on itself, similar to the configuration shown in FIG. 3. Finally, as shown in block 330, the top and bottom pieces are situated so as to be in zipper-less communication with each other. In this manner, the mattress is completely encased by the top and bottom pieces of the encasing.

It should be emphasized that the above-described embodiments of the encasing systems, beds, and methods are merely possible examples of implementations of the encasing systems, beds, and methods, and are merely set forth for a clear understanding of the principles set forth herein. Many variations and modifications may be made to the encasing systems, beds, and methods disclosed herein without departing substantially from the spirit and principles of the disclosure. All such modifications and variations are intended to be included herein within the scope of this disclosure and protected by the following claims.

The invention claimed is:

1. A zipper-less encasing system for a mattress, comprising:

a bottom encasing configured to fit snugly over a bottom portion of the mattress; and a top encasing configured to fit snugly over a top portion of the mattress and overlap with a portion of the bottom encasing;

wherein the mattress is completely covered by portions of both the bottom encasing and the top encasing;

wherein the bottom encasing comprises:

a bottom portion configured to fit a bottom side of the mattress; and four side portions configured to at least partially cover sides of the mattress, wherein the four side portions extend up continuously from the bottom portion, without seams; and wherein the four side portions comprise:

a bottom edge that is adjacent the bottom portion of the bottom encasing; and a top edge that surrounds the sides of the mattress, wherein the top edge is bound with an elastic seam that holds the bottom encasing snugly against the mattress.

2. The system of claim 1, wherein the four side portions of the bottom encasing are connected with seams to each other at each of the four corners of the mattress.

3. The system of claim 1, wherein, when the bottom encasing is disposed on the mattress, the top edge of the bottom encasing folds back over itself, whereby the sides of the mattress are covered in part by two layers of the bottom encasing.

4. The system of claim 1, wherein the top encasing and the bottom encasing are made from different materials.

5. The system of claim 1, wherein the top encasing is made from a material chosen from at least one of: a knit polyester, a knit polyester with a polyurethane backing, a spunbond/meltblown/spunbond olefin, a woven polyester, a woven cotton-polyester blend, and combinations thereof.

6. The system of claim 5, wherein the spunbond/meltblown/spunbond olefin material comprises:

two spunbond olefin layers heat bonded to each side of a meltblown olefin layer.

7. The system of claim 5, wherein the woven polyester is woven tight enough to prevent dust mites and dust mite allergens from passing through the woven polyester material.

8. A zipper-less encasing system for a mattress, comprising:

a bottom encasing configured to fit snugly over a bottom portion of the mattress; and a top encasing configured to fit snugly over a top portion of the mattress and overlap with a portion of the bottom encasing;

wherein the mattress is completely covered by portions of both the bottom encasing and the top encasing; and wherein the top encasing comprises:

a top portion configured to fit a top side of the mattress;

four side portions configured to at least partially cover sides of the mattress, wherein the four side portions extend down continuously from the top portion, without seams; and a bottom portion configured to at least partially cover a bottom side of the mattress.

9. The system of claim 8, wherein the four side portions of the top encasing are connected with seams to each other at each of the four corners of the mattress.

10. The system of claim 8, wherein the four side portions comprise:

a top edge that is adjacent the top portion of the top encasing; and a bottom edge that is adjacent the bottom portion of the top encasing and surrounds the sides of the mattress.

11. The system of claim 10, wherein the bottom portion of the top encasing is bound with an elastic seam that holds the top encasing snugly against the bottom encasing.

12. A mattress comprising:

a top portion, a bottom portion, and multiple side portions; and means for encasing the top portion, bottom portion, and side portions, the encasing means comprising:

means for encasing the bottom portion, the bottom portion encasing means further configured to at least partially encase the side portions; and means for encasing the top portion, the top portion encasing means further configured to at least partially encase the side portions;

wherein at least one section of the top portion encasing means overlaps the bottom portion encasing means to completely covers the top portion, bottom portion, and side portions; and wherein the encasing means comprises an elastic component configured to hold the encasing means against at least one of the side portions or bottom portion.

13. The mattress of claim 12, wherein the encasing means further comprises a material that is configured to act as a barrier to prevent dust mites and dust mite allergens from passing therethrough.

14. The mattress of claim 12, wherein the encasing means further comprises a material that is configured to act as a barrier to prevent cat dander from passing therethrough.

15. The mattress of claim 12, wherein the encasing means further comprises a material that is configured to allow airflow of at least about 29 liters/minute.

16. The mattress of claim 15, wherein the encasing means further comprises a fabric configured to allow less than about 0.31 ng of *Felis domesticus* (Fel d1) therethrough.

17. The mattress of claim 15, wherein the encasing means further comprises a fabric that is configured to allow less than about 1.25 ng of *Dermatophagoides farinae* (Der f1) therethrough.

18. The mattress of claim 12, wherein the top portion encasing means comprises a fabric having tightly woven microfibers, the fabric configured to act as a barrier to household allergens.

19. The mattress of claim 12, wherein the top portion encasing means comprises a fabric having a mean pore size of about 3.2 μm to about 3.3 μm.

20. The mattress of claim 12, wherein the bottom portion encasing means and the top portion encasing means have a fewer number of seams than encasings that include a zipper.

21. The mattress of claim 12, wherein the bottom portion encasing means comprises an elastic component configured to hold the bottom portion encasing means against the side portions and the top encasing means comprises an elastic component configured to hold the top portion encasing means against the bottom portion.

22. The mattress of claim 12, wherein the size of the mattress is selected from one of the following sizes: crib, twin, extra-long twin, full, double, queen, king, European queen, and California king.

23. A method of encasing the mattress of claim 12, the method comprising:

fitting the bottom portion encasing means over the bottom portion;

fitting the top portion encasing means over the top portion such that at least one section of the top portion encasing means overlaps the bottom portion encasing means, thereby completely covering the top portion, bottom portion, and side portions.

* * * * *